US011427904B2

(12) United States Patent
Task et al.

(10) Patent No.: US 11,427,904 B2
(45) Date of Patent: Aug. 30, 2022

(54) COATING SYSTEM FOR INTERNALLY-COOLED COMPONENT AND PROCESS THEREFOR

(71) Applicant: UNITED TECHNOLOGIES CORPORATION, Hartford, CT (US)

(72) Inventors: Michael N Task, Vernon, CT (US); Brian T Hazel, Avon, CT (US); Kevin L Collins, Mansfield, TX (US); Michael J Minor, Mansfield, TX (US)

(73) Assignee: Raytheon Technologies Corporation, Farmington, CT (US)

( * ) Notice: Subject to any disclaimer, the term of this patent is extended or adjusted under 35 U.S.C. 154(b) by 1029 days.

(21) Appl. No.: 14/887,447

(22) Filed: Oct. 20, 2015

(65) Prior Publication Data

US 2016/0108513 A1 Apr. 21, 2016

Related U.S. Application Data

(60) Provisional application No. 62/065,907, filed on Oct. 20, 2014, provisional application No. 62/149,863, filed on Apr. 20, 2015.

(51) Int. Cl.

| | |
|---|---|
| ***C23C 10/32*** | (2006.01) |
| ***C23C 10/60*** | (2006.01) |
| ***C21D 9/00*** | (2006.01) |
| ***C23C 28/00*** | (2006.01) |
| ***C23C 24/08*** | (2006.01) |
| ***C23C 10/30*** | (2006.01) |
| ***F01D 5/18*** | (2006.01) |

(Continued)

(52) U.S. Cl.

CPC ..... *C23C 10/32* (2013.01); *C21D 9/0068* (2013.01); *C23C 10/30* (2013.01); *C23C 10/60* (2013.01); *C23C 24/08* (2013.01); *C23C 28/3215* (2013.01); *C23C 28/347* (2013.01); *C23C 28/3455* (2013.01); *F01D 5/187* (2013.01); *F01D 5/288* (2013.01); *F05D 2230/90* (2013.01); *F05D 2300/132* (2013.01)

(58) Field of Classification Search

CPC ..... C21D 9/0068; C23C 10/30; C23C 10/32; C23C 10/60; C23C 28/3215; C23C 28/3455; C23C 28/347; F01D 5/187; F01D 5/288

See application file for complete search history.

(56) References Cited

U.S. PATENT DOCUMENTS 3,989,096 A 11/1976 Allardyce et al.
4,346,137 A 8/1982 Hecht (Continued)

FOREIGN PATENT DOCUMENTS

EP 0984074 A1 3/2000
EP 2060653 A2 5/2009
EP 2371986 A1 10/2011

OTHER PUBLICATIONS

European Office Action dated Jan. 29, 2018 for corresponding European Patent Application 15190516.3.

*Primary Examiner* — Lois L Zheng

(74) *Attorney, Agent, or Firm* — Bachman & LaPointe, P.C.

(57) ABSTRACT

A method of coating includes applying a metallic coating slurry without a filler to a component; draining the metallic coating slurry; drying the metallic coating slurry to drive off the organic binder; and heat treating the component.

8 Claims, 5 Drawing Sheets

(51) Int. Cl.

| | |
|---|---|
| *C23C 10/38* | (2006.01) |
| *C23C 28/02* | (2006.01) |
| *F01D 5/28* | (2006.01) |

(56) References Cited

U.S. PATENT DOCUMENTS

| | | | | |
|---|---|---|---|---|
| 4,350,719 | A | 9/1982 | Baldi | |
| 4,585,481 | A | 4/1986 | Gupta et al. | |
| 4,615,865 | A | 10/1986 | Duvall et al. | |
| 4,965,095 | A | 10/1990 | Baldi | |
| 4,977,036 | A | 12/1990 | Baldi | |
| 5,182,078 | A | 1/1993 | Baldi | |
| 5,478,413 | A | 12/1995 | Mosser et al. | |
| 5,652,064 | A | 7/1997 | Mosser et al. | |
| 5,803,990 | A | 9/1998 | Mosser et al. | |
| 5,989,733 | A | 11/1999 | Warnes et al. | |
| 6,036,995 | A | 3/2000 | Kircher et al. | |
| 6,074,464 | A | 6/2000 | Eddinger et al. | |
| 6,110,262 | A * | 8/2000 | Kircher | C23C 10/30 106/14.21 |
| 6,150,033 | A | 11/2000 | Mosser et al. | |
| 6,224,657 | B1 | 5/2001 | Myers et al. | |
| 6,299,935 | B1 | 10/2001 | Park et al. | |
| 6,395,406 | B1 | 5/2002 | Sangeeta | |
| 6,413,582 | B1 | 7/2002 | Park et al. | |
| 6,428,630 | B1 | 8/2002 | Mor et al. | |
| 6,485,780 | B1 | 11/2002 | Sangeeta et al. | |
| 6,511,630 | B1 | 1/2003 | Cartier et al. | |
| 6,585,481 | B1 | 7/2003 | Sandkleiva | |
| 6,613,445 | B2 | 9/2003 | Sangeeta et al. | |
| 6,793,966 | B2 | 9/2004 | Warnes et al. | |
| 6,919,042 | B2 | 7/2005 | Beers et al. | |
| 7,270,852 | B2 | 9/2007 | Kool et al. | |
| 7,326,470 | B2 | 2/2008 | Ulion et al. | |
| 7,575,815 | B2 | 8/2009 | Henager, Jr. et al. | |
| 7,597,934 | B2 | 10/2009 | Nagaraj et al. | |
| 7,829,142 | B2 | 11/2010 | Kool et al. | |
| 7,896,962 | B2 | 3/2011 | Kool et al. | |
| 7,993,759 | B2 | 8/2011 | Nagaraj et al. | |
| 8,021,491 | B2 | 9/2011 | Kool et al. | |
| 8,641,963 | B2 | 2/2014 | Tryon et al. | |
| 2004/0115355 | A1 | 6/2004 | Bauer et al. | |
| 2007/0079507 | A1 | 4/2007 | Cheng et al. | |
| 2008/0044663 | A1 | 2/2008 | Freling et al. | |
| 2009/0162209 | A1 * | 6/2009 | Wortman | F01D 5/288 416/241 R |
| 2010/0266409 | A1 | 10/2010 | Chandra et al. | |
| 2012/0060721 | A1 * | 3/2012 | Kool | C23C 10/18 106/14.21 |
| 2013/0164558 | A1 | 6/2013 | Zimmerman et al. | |
| 2014/0004372 | A1 | 1/2014 | Collins et al. | |
| 2014/0134447 | A1 | 5/2014 | Murphy | |
| 2015/0197841 | A1 * | 7/2015 | Tang | C23C 10/20 427/252 |
| 2015/0197842 | A1 * | 7/2015 | Tang | C23C 10/04 428/666 |

* cited by examiner

COATING SYSTEM FOR INTERNALLY-COOLED COMPONENT AND PROCESS THEREFOR

CROSS REFERENCE TO RELATED APPLICATIONS

This application claims the benefit of provisional application Ser. No. 62/065,907, filed Oct. 20, 2014 and provisional application Ser. No. 62/149,863, filed Apr. 20, 2015.

BACKGROUND

The present disclosure relates to coating materials and, more particularly, to chromizing slurry coating compositions for protection of a metal substrate.

Gas turbine engines typically include a compressor section to pressurize airflow, a combustor section to burn a hydrocarbon fuel in the presence of the pressurized air, and a turbine section to extract energy from the resultant combustion gases. Gas path components, such as turbine blades, often include airfoil cooling that may be accomplished by external film cooling, internal air impingement and forced convection either separately, or in combination.

The internal cavities include internal passages to direct the passage of the cooling air. As gas turbine temperatures have increased, the geometries of these cooling passages have become progressively more circuitous and complex. Such internal passages are often coated with a metallic coating such as via a diffusion chromizing process to prevent hot corrosion thereof. Components to be coated are typically placed in a retort for distillation, Cr-containing vapor species are generated and supplied to the components via gas phase transport, and a Cr-rich coating is formed. Although effective, the vapor phase chromizing process may suffer from an inability to achieve sufficient coverage and Cr content on some components, particular the complex internal passageway of relatively small first stage High Pressure Turbine (HPT) blades.

SUMMARY

A metallic chromium slurry according to one disclosed non-limiting embodiment of the present disclosure includes a Chromium powder and an activator mixed with the chromium power.

A further embodiment of the present disclosure includes, wherein the activator includes Chromium Chloride ($CrCl_3$) particles.

A further embodiment of any of the foregoing embodiments of the present disclosure includes, wherein the Chromium Chloride ($CrCl_3$) particles defines about 0.9-3.4% by weight.

A further embodiment of any of the foregoing embodiments of the present disclosure includes, wherein the Chromium powder defines about 48.5-68% by weight.

A further embodiment of any of the foregoing embodiments of the present disclosure includes an organic binder mixed with the activator and the chromium powder, the organic binder including an n-propyl bromide-based organic binder.

A further embodiment of any of the foregoing embodiments of the present disclosure includes, wherein the organic binder includes a Klucel H (hydroxypropyl cellulose).

A further embodiment of any of the foregoing embodiments of the present disclosure includes, wherein the organic binder defines about 30-50% by weight.

A further embodiment of any of the foregoing embodiments of the present disclosure includes, wherein the activator defines about 0.9-3.4% by weight.

A further embodiment of any of the foregoing embodiments of the present disclosure includes, wherein the activator defines about 0.9-3.4% by weight, the Chromium powder defines about 48.5-68% by weight, an organic binder mixed with the activator and the chromium powder, the organic binder organic binder defines about 30-50% by weight.

A further embodiment of any of the foregoing embodiments of the present disclosure includes, the activator defines about 0.03% by weight, the Chromium powder defines about 97% by weight.

A further embodiment of any of the foregoing embodiments of the present disclosure includes, wherein the chromium slurry does not include a filler.

A further embodiment of any of the foregoing embodiments of the present disclosure includes, wherein the chromium slurry defines a viscosity of about 100-200 cp.

A method of coating, according to another disclosed non-limiting embodiment of the present disclosure includes applying a metallic coating slurry without a filler to a component; draining the metallic coating slurry; drying the metallic coating slurry to drive off the organic binder; and heat treating the component.

A further embodiment of any of the foregoing embodiments of the present disclosure includes, wherein the metallic coating slurry is a chromium slurry.

A further embodiment of any of the foregoing embodiments of the present disclosure includes, wherein the chromium slurry defines a viscosity of about 100-200 cp.

A further embodiment of any of the foregoing embodiments of the present disclosure includes, wherein the applying including flowing the metallic coating slurry into an array of internal passageways of the component.

A further embodiment of any of the foregoing embodiments of the present disclosure includes, wherein the component is a blade.

A further embodiment of any of the foregoing embodiments of the present disclosure includes, wherein the component is a vane.

A further embodiment of any of the foregoing embodiments of the present disclosure includes, wherein the drying includes drying at about 200 F for about 1 hour.

A further embodiment of any of the foregoing embodiments of the present disclosure includes, wherein the heat treating includes heat treating at about 1925 F (1052 C) to about 2000 F (1093 C), for a time of from about 5 to about 6 hours.

A coated component according to one disclosed non-limiting embodiment of the present disclosure can include a substrate having an array of internal passageways within the component; a Chromium-enriched layer within the array of internal passageways; and a bondcoat atop the substrate.

A further embodiment of the present disclosure may include, wherein the Chromium-enriched layer is a Chromium-enriched single phase $\gamma$ face centered cubic Ni-based solid solution layer.

A further embodiment of any of the foregoing embodiments of the present disclosure may include, wherein the solid solution layer is about 10-30 microns thick.

A further embodiment of any of the foregoing embodiments of the present disclosure may include, wherein the substrate includes a superalloy.

A further embodiment of any of the foregoing embodiments of the present disclosure may include, wherein the Chromium-enriched layer is applied as a slurry that includes a Chromium powder and an activator mixed with the chromium power.

A further embodiment of any of the foregoing embodiments of the present disclosure may include 5, wherein the activator includes Chromium Chloride ($CrCl_3$) particles.

A further embodiment of any of the foregoing embodiments of the present disclosure may include, wherein the Chromium Chloride ($CrCl_3$) particles defines about 0.9-3.4% by weight.

A further embodiment of any of the foregoing embodiments of the present disclosure may include, wherein the Chromium powder defines about 48.5-68% by weight.

A further embodiment of any of the foregoing embodiments of the present disclosure may include an organic binder mixed with the activator and the chromium powder, the organic binder including an n-propyl bromide-based organic binder.

A further embodiment of any of the foregoing embodiments of the present disclosure may include, wherein the organic binder includes an Klucel H (hydroxypropyl cellulose).

A further embodiment of any of the foregoing embodiments of the present disclosure may include, wherein the organic binder defines about 30-50% by weight.

A further embodiment of any of the foregoing embodiments of the present disclosure may include, wherein the activator defines about 0.9-3.4% by weight.

A further embodiment of any of the foregoing embodiments of the present disclosure may include, wherein the activator defines about 0.9-3.4% by weight, the Chromium powder defines about 48.5-68% by weight, an organic binder mixed with the activator and the chromium powder, the organic binder organic binder defines about 30-50% by weight.

A further embodiment of any of the foregoing embodiments of the present disclosure may include, wherein the activator defines about 0.03% by weight, the Chromium powder defines about 97% by weight.

A further embodiment of any of the foregoing embodiments of the present disclosure may include, wherein the bondcoat is cathodic arc deposited.

A further embodiment of any of the foregoing embodiments of the present disclosure may include, wherein the coated component is a blade.

A further embodiment of any of the foregoing embodiments of the present disclosure may include, wherein the coated component is a vane.

A method of coating a component according to another disclosed non-limiting embodiment of the present disclosure can include applying a chromium slurry to an array of internal passageways within the component; and cathodic arc depositing a bondcoat to an external surface of the component.

A further embodiment of any of the foregoing embodiments of the present disclosure may include, wherein the chromium slurry is without a filler and defines a viscosity of about 100-200 cp.

A further embodiment of any of the foregoing embodiments of the present disclosure may include applying a TBC atop the bondcoat.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
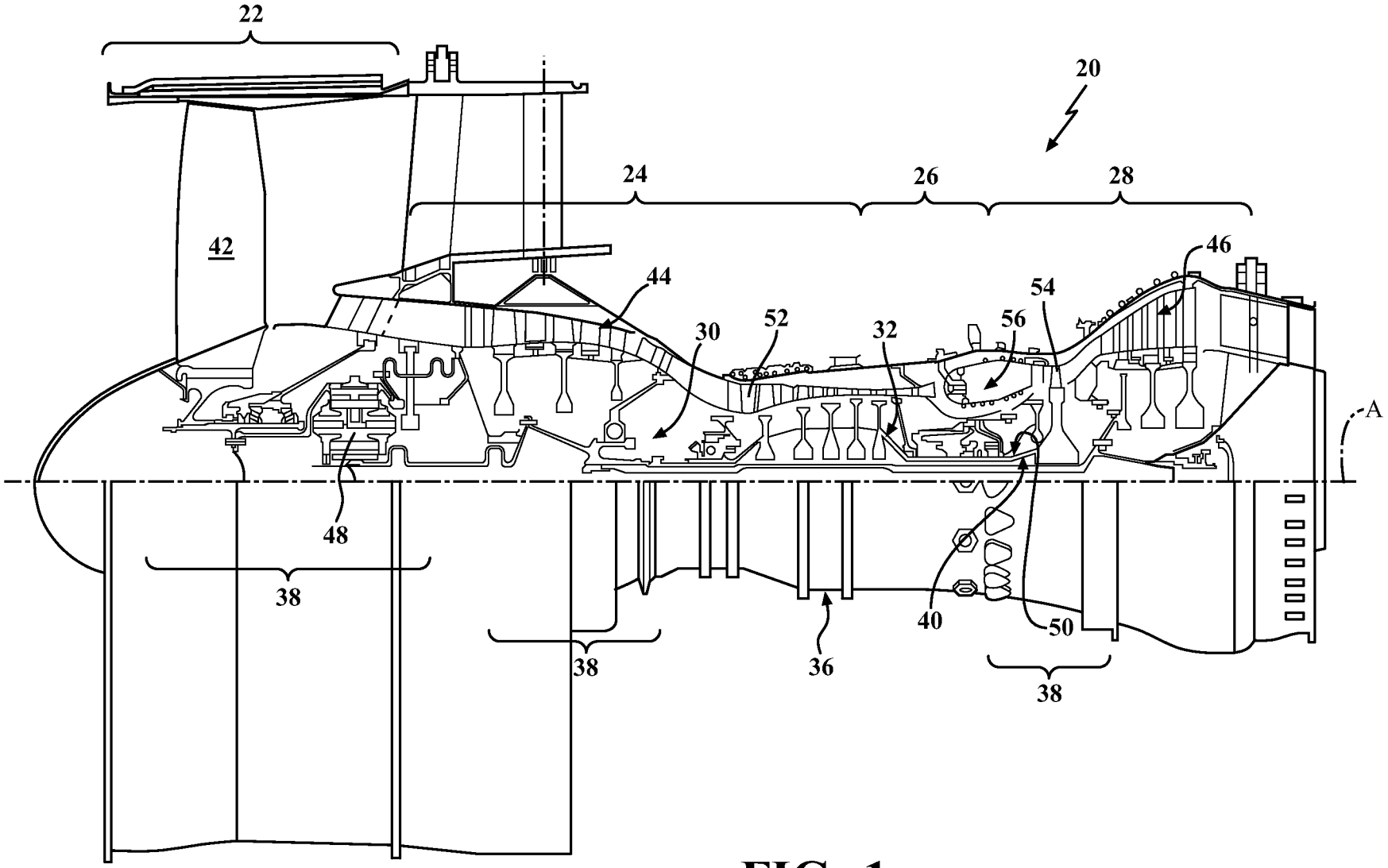
FIG. 1 is a schematic cross-section of an example gas turbine engine architecture.

FIG. 1 schematically illustrates a gas turbine engine 20. The gas turbine engine 20 is disclosed herein as a two-spool turbo fan that generally incorporates a fan section 22, a compressor section 24, a combustor section 26 and a turbine section 28. The fan section 22 drives air along a bypass flowpath and along a core flowpath for compression by the compressor section 24, communication into the combustor section 26, then expansion through the turbine section 28. Although depicted as a turbofan in the disclosed non-limiting embodiment, it should be understood that the concepts described herein are not limited to use with turbofans as the teachings may be applied to other types of turbine engine architectures such as low bypass turbofans, turbojets, turboshafts, three-spool (plus fan) turbofans and other non-gas turbine components.

The engine 20 generally includes a low spool 30 and a high spool 32 mounted for rotation about an engine central longitudinal axis "A". The low spool 30 generally includes an inner shaft 40 that interconnects a fan 42, a low pressure compressor ("LPC") 44 and a low pressure turbine ("LPT") 46. The inner shaft 40 drives the fan 42 directly, or through a geared architecture 48 at a lower speed than the low spool 30. An exemplary reduction transmission is an epicyclic transmission, namely a planetary or star gear system.

The high spool 32 includes an outer shaft 50 that interconnects a high pressure compressor ("HPC") 52 and high pressure turbine ("HPT") 54. A combustor 56 is arranged between the high pressure compressor 52 and the high pressure turbine 54. The inner shaft 40 and the outer shaft 50 are concentric and rotate about the engine central longitudinal axis "A," which is collinear with their longitudinal axes.

Core airflow is compressed by the LPC 44, then the HPC 52, mixed with the fuel and burned in the combustor 56, then expanded over the HPT 54, then the LPT 46. The turbines 54, 46 rotationally drive the respective high spool 32 and low spool 30 in response to the expansion. The main engine shafts 40, 50 are supported at a plurality of points by bearing structures 38 within the static structure 36.

Figure 2:
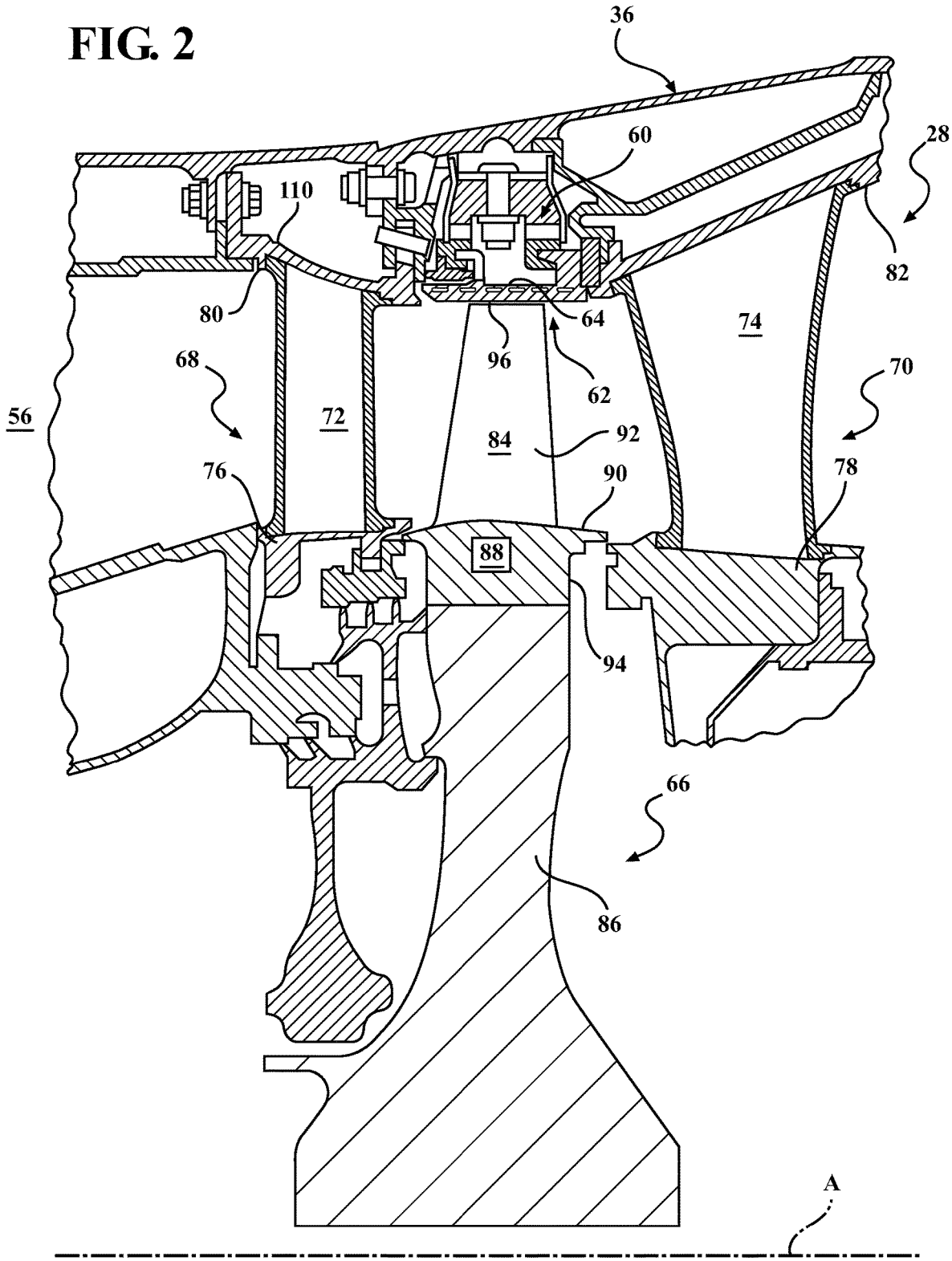
FIG. 2 is an enlarged schematic cross-section of an engine turbine section.

With reference to FIG. 2, an enlarged schematic view of a portion of the turbine section 28 is shown by way of example; however, other engine sections will also benefit herefrom. A shroud assembly 60 within the engine case structure 36 supports a blade outer air seal (BOAS) assembly 62 with a multiple of circumferentially distributed BOAS 64 proximate to a rotor assembly 66 (one schematically shown).

The shroud assembly 60 and the BOAS assembly 62 are axially disposed between a forward stationary vane ring 68 and an aft stationary vane ring 70. Each vane ring 68, 70 includes an array of vanes 72, 74 that extend between a respective inner vane platform 76, 78 and an outer vane platform 80, 82. The outer vane platforms 80, 82 are attached to the engine case structure 36.

The rotor assembly 66 includes an array of blades 84 circumferentially disposed around a disk 86. Each blade 84 includes a root 88, a platform 90 and an airfoil 92 (also shown in FIG. 3). The blade roots 88 are received within a rim 94 of the disk 86 and the airfoils 92 extend radially outward such that a tip 96 of each airfoil 92 is closest to the blade outer air seal (BOAS) assembly 62. The platform 90 separates a gas path side inclusive of the airfoil 92 and a non-gas path side inclusive of the root 88.

Figure 3:
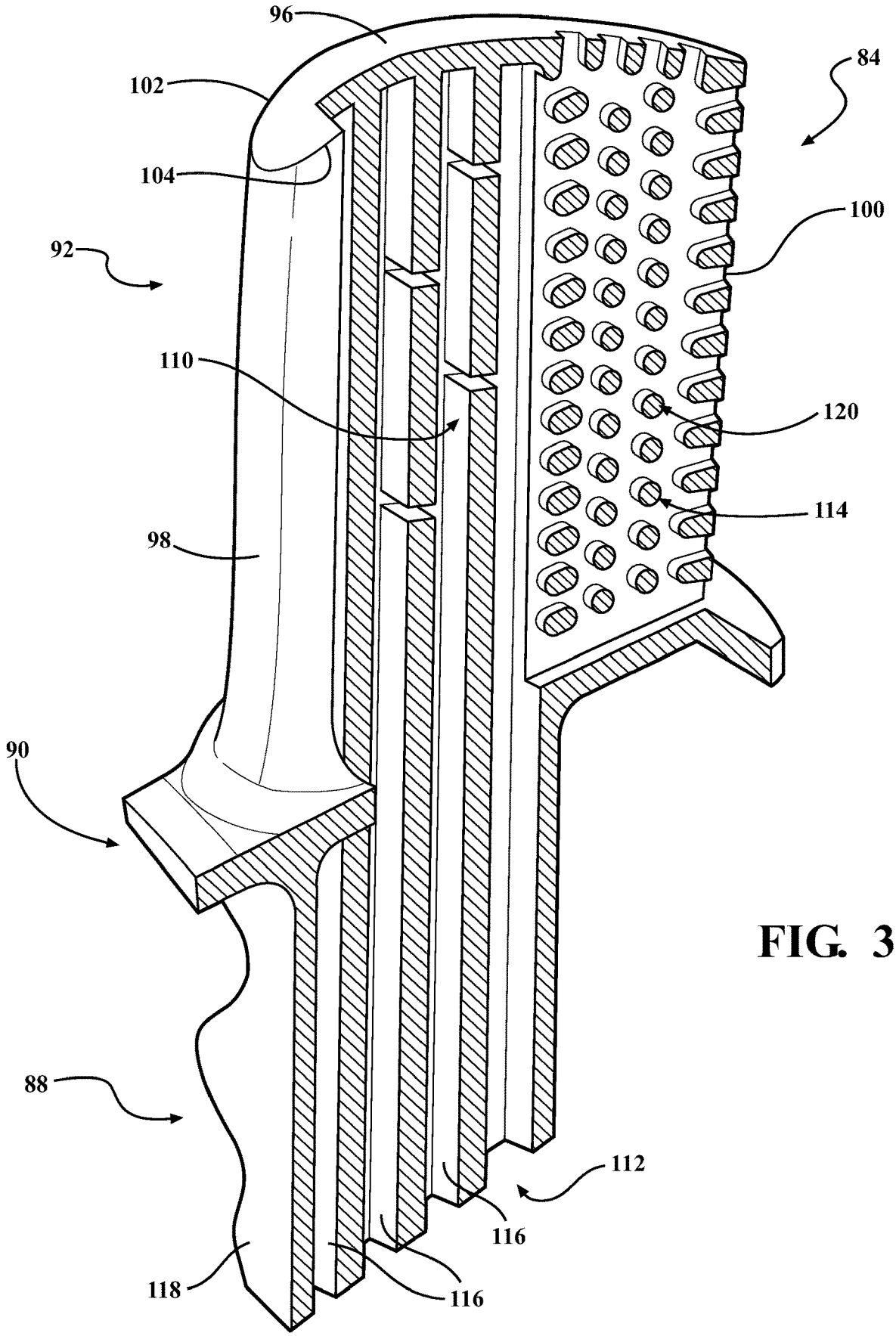
FIG. 3 is a perspective view of an airfoil as an example component for use with a coating method showing the internal architecture.

With reference to FIG. 3, the platform 90 generally separates the root 88 and the airfoil 92 to define an inner boundary of a gas path. The airfoil 92 defines a blade chord between a leading edge 98, which may include various forward and/or aft sweep configurations, and a trailing edge 100. A first sidewall 102 that may be convex to define a suction side, and a second sidewall 104 that may be concave to define a pressure side are joined at the leading edge 98 and at the axially spaced trailing edge 100. The tip 96 extends between the sidewalls 102, 104 opposite the platform 90. It should be appreciated that the tip 96 may include a recessed portion.

To resist the high temperature stress environment in the gas path of a turbine engine, each blade 84 may be formed by casting. It should be appreciated that although a blade 84 with an array of internal passageways 110 (shown schematically) will be described and illustrated in detail, other hot section components including, but not limited to, vanes, turbine shrouds, end walls and other components will also benefit from the teachings herein.

The external airfoil surface may be protected by a protective coating that overlies and contacts the external airfoil surface. Such coatings may be of the MCrAIX type. The terminology "MCrAIX" is a shorthand term of art for a variety of families of overlay protective layers that may be employed as environmental coatings or bond coats in thermal barrier coating systems. In this, and other forms, M refers to nickel, cobalt, iron, and combinations thereof. In some of these protective coatings, the chromium may be omitted. The X denotes elements such as hafnium, zirconium, yttrium, tantalum, rhenium, ruthenium, palladium, platinum, silicon, titanium, boron, carbon, and combinations thereof. Specific compositions are known in the art. Optionally, a ceramic layer overlies and contacts the protective layer. The ceramic layer is preferably yttria-stabilized zirconia, which is a zirconium oxide. Other operable ceramic materials may be used as well. Typically, when there is no ceramic layer present, the protective layer is termed an "environmental coating." When there is a ceramic layer present, the protective layer is termed a "bond coat."

The array of internal passageways 110 generally includes one or more feed passages 112 that communicate airflow into a trailing edge cavity 114 within the airfoil 84. It should be appreciated that the array of internal passageways 110 may be of various geometries, numbers and configurations and the feed passage 112 in this embodiment is the aft most passage that communicates cooling air to the trailing edge cavity 114. The feed passage 112 generally receives cooling flow through at least one inlet 116 within a base 118 of the root 88.

The trailing edge cavity 114 may include a multiple of trailing edge cavity features 120 that result in a circuitous and complex cooling airflow path. It should be appreciated that although particular features are delineated within certain general areas, the features may be otherwise arranged or intermingled and still not depart from the disclosure herein.

The array of internal passageways 110 are generally present in various gas turbine components, such as the example blade 84, to allow for the passage of cooling air. As gas turbine temperatures have increased, the geometries of these cooling passages have become progressively more circuitous and complex. These internal passages 110, as well as other portions of the workpiece, are often coated with a metallic coating applied via a diffusion chromizing process to prevent hot corrosion. Generally, components are placed in a retort for distillation, Cr-containing vapor species are generated and supplied to the surface of the components via gas phase transport, and a Cr-rich coating is formed. Although effective, the vapor phase chromizing process may suffer from an inability to achieve sufficient coverage and Cr content on some components, particular relatively small first stage High Pressure Turbine (HPT) blades.

The example component workpiece, such as the blade 84, is typically manufactured of a nickel-base alloy, and more preferably of a nickel-base superalloy. A nickel-base alloy has more nickel than any other element, and a nickel-base superalloy is a nickel-base alloy that is strengthened by the precipitation of gamma prime or a related phase. The component, and thence a substrate and the internal passageways thereof, are thus of nickel-base alloy, and more preferably are a nickel-base superalloy.

Figure 4:
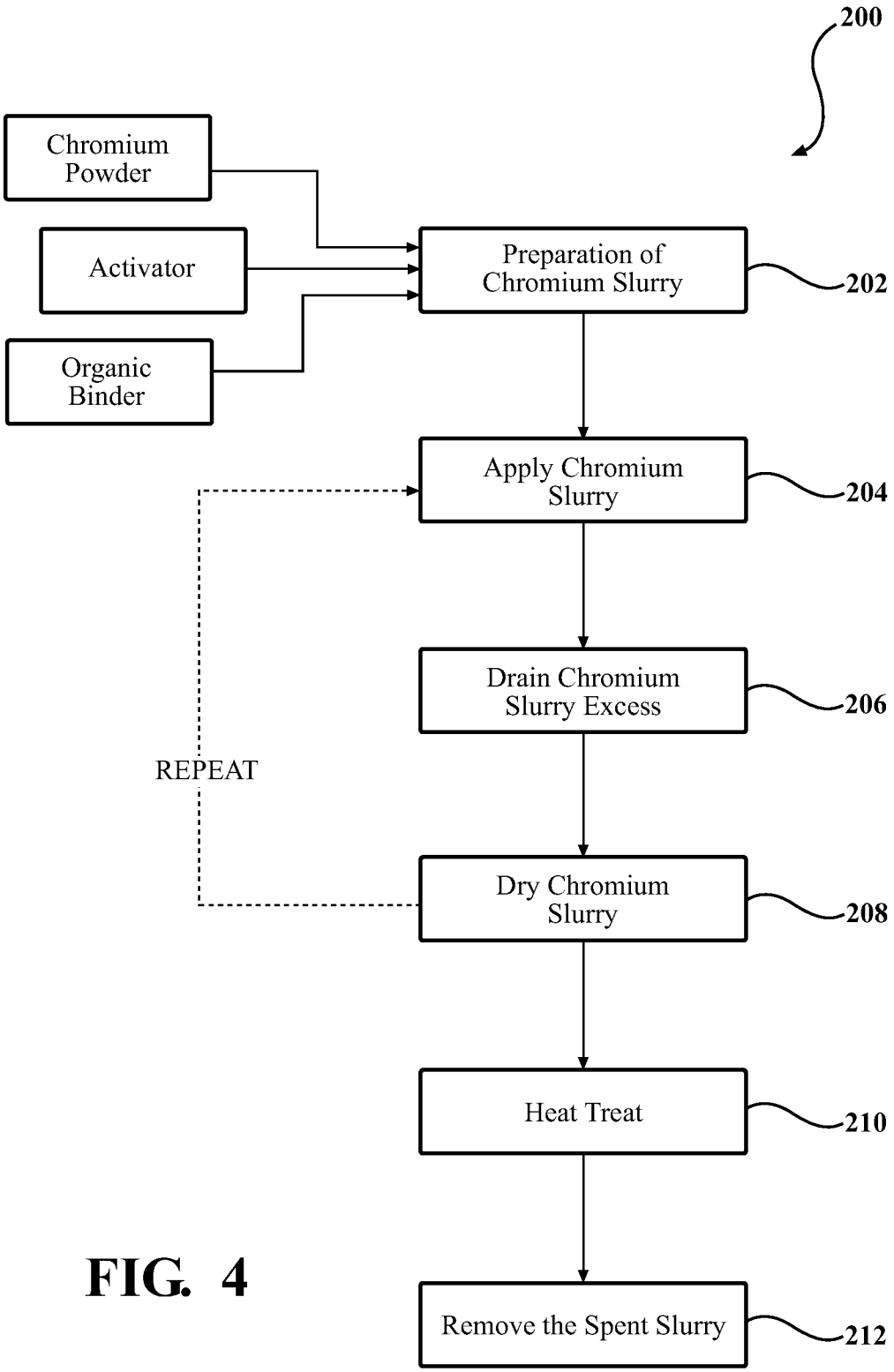
FIG. 4 is a block diagram representing a method of coating an array of internal passageways of a component.

With reference to FIG. 4, one disclosed non-limiting embodiment of a method 200 for applying a metallic coating, such as diffusion chromizing that readily achieves sufficient coverage and Cr content, initially includes preparation of a Chromium (Cr) slurry (step 202). The Chromium slurry includes a mixture of Chromium powder, Chromium Chloride ($CrCl_3$) particles as an activator, and, optionally, an organic binder. There is substantially no filler in the slurry. Other slurry coatings contain aluminum oxide filler, but the present work has determined that the presence of such a filler in a coating slurry that is used to coat internal surfaces such as the array of internal passageways 110 is a primary cause of undesirable obstruction and/or flow disturbances within the array of internal passageways 110.

The Chromium (Cr) slurry, in one example in terms of weight percentages, includes about 48.5-68% by weight Chromium powder, about 0.9-3.4% by weight Chromium Chloride ($CrCl_3$) particles, and about 30-50% by weight organic binder. The resultant Chromium (Cr) slurry forms a low-viscosity fluid capable of being flowed through internal passages. In one example, the slurry has a viscosity of about 100-200 cp. Any operable organic binder may be used. Examples include, but are not limited to, B4 (n-propyl bromide-based organic binder such as that from Akron Paint and Varnish) and Klucel H (hydroxypropyl cellulose), and mixtures thereof. Other organic binders such as a water based organic binder may alternatively be utilized.

The Chromium (Cr) slurry, in another example without an organic binder in terms of weight percentages, includes about 97% by weight Chromium powder and about 0.03% by weight Chromium Chloride ($CrCl_3$) particles.

Next, the Chromium slurry is applied to the component (step 204). The Chromium slurry, for example, can be flowed through the component to achieve coverage on complex geometries, here, the array of internal passageways 110. The Chromium slurry may be applied to the component, for example, by pouring, injecting or otherwise flowing the slurry into the array of internal passageways 110. In another disclosed non-limiting embodiment, such as a repair procedure for the root 88, the component, or a portion thereof, may be dipped therein. Alternately, the Chromium slurry is applied via other carriers, devices, and/or methods.

Next, the excess Chromium slurry is drained away (step 206). Simply allowing the relatively viscous Chromium slurry to flow out of the internal passageways 110 may perform such draining.

The Chromium slurry is then dried to drive off the organic binder (step 208). The drying evaporates the flowable carrier component of the organic binder (e.g., flowable organic solvents and water) of the Chromium slurry, leaving the organic binder that binds the particles together. Driving off the organic binder is performed at a relatively low temperature for short periods of time. In one example, drying of the binder is performed at about 200 F (93 C) for about 1 hour. Alternatively, the drying could be performed at room temperature given a commensurate greater time period. The applying, draining and drying steps may also be repeated multiple times to achieve a desired thickness and/or coverage.

Next, the component is heat treated (step 210). In one example, heat treat may be accomplished at a temperature of from about 1600 F (871 C) to about 2100 F (1149 C) most preferably from about 1925 F (1052 C) to about 2000 F (1093 C), for a time of from about 4 to about 8 hours, preferably, from about 5 to about 6 hours. The heat treating may be performed in an inert (e.g., argon) or reducing (e.g., hydrogen) atmosphere. In the case of the inert atmosphere, the atmosphere is largely free of oxygen and oxygen-containing species such as water vapor.

The heat treat allows, through a mechanism involving the reaction of the Cr powder with the activator, gas phase transport of Cr-containing species to the component surface, and subsequent diffusion of Cr into the parent material, the formation of a coating that, in one disclosed non-limiting embodiment, is an about 10-30 microns thick Chromium-enriched single phase $\gamma$ face centered cubic Ni-based solid solution layer that prevents hot corrosion.

Finally, after the heat treatment (step 210) the "spent" slurry is removed (step 212). There is essentially a friable crust of Cr powder on the array of internal passageways 110 after the heat treatment, and this is to be removed. In one example, warm Hydrogen Cloride (HCl) may be utilized to dissolve away this material. Alternatively, or in addition thereto, physical methods, e.g., high pressure flushing with water may be utilized to remove the crust of Cr powder.

The Chromium slurry advantageously facilitates coating of complex geometries, here, the array of internal passageways 110, as well as permits coating of external surfaces to, for example repair surfaces that have been previously vapor phase chromized but did not achieve sufficient coverage, and/or Cr content.

The Chromium slurry application process advantageously results in a coating that will provide hot corrosion resistance with several advantages over traditional vapor phase chromizing processes. The Chromium slurry is readily applied in a localized manner with very little "overspray" allowing for the deposition of the coating only on the intended areas. The Chromium slurry also readily flows through relatively complex structures to achieve excellent coverage.

The Cr-rich coating formed by the Chromium slurry readily combats high temperature oxidation/corrosion of superalloys and steels at temperatures up to about 1900 F (1038 C) and may be readily utilized, in addition to gas turbine components, for chemical refining, oil, gas, and power generation type components.

Figure 5:
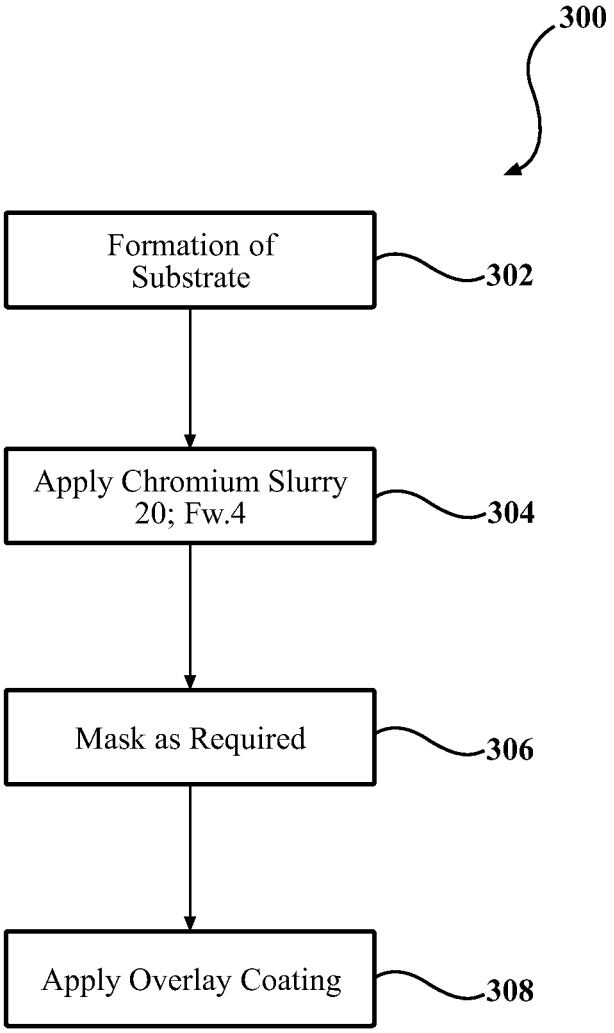
FIG. 5 is a block diagram representing a method of coating a component.

With reference to FIG. 5, one disclosed non-limiting embodiment of a method 300 for applying a metallic coating to a component such as the blade 84 (FIG. 3) initially includes formation of the substrate such as via casting, finish maching, and optionally further treated such as by peening, chemical etching, etc., (step 302). A particularly significant area involves high pressure turbine blades. In a two-spool or three-spool (or more) engine, the high pressure turbine (HPT) is the turbine section immediately downstream of the combustor. The intermediate pressure turbine (IPT) when present and low pressure turbine (LPT) are downstream of the HPT where cooling may have reduced temperatures. It should be appreciated that although the blade 84 is illustrated in the disclose embodiment, any such component desired to have highest oxidation resistance with lowest impact to part weight, as well as internal corrosion protection will benefit herefrom.

Next the Chromium slurry is applied (FIG. 4) into the array of internal passageways 110 (step 304). As discussed above the Chromium slurry application is readily applied in a localized manner with very little "overspray" allowing for the deposition of the coating only on the intended areas. The Chromium slurry provide internal corrosion protection from PWA70 coating, high resistance to airfoil oxidation from cathodic arc metallic bondcoat, and high CMAS resistance from external electron beam-physical vapor deposition (EB-PVD) ceramic coating.

Next, the Chromium slurry application areas may be masked (step 306). The mask may be performed via a relatively uncomplicated plugging/blocking of the openings to the array of internal passageways 110. Other certain external areas such as the root and underplatform (e.g., the surfaces not directly in the gaspath) may also be masked by sacrificial coating, taping, mechanical fixturing/masking or the like.

Next, an overlay coating is applied to gas path surfaces of the blade 84 such as the airfoil 92 and the upper surfaces of the platform 90 (step 308). The significant portions of the exterior may be along essentially the entire exterior or a portion of the exterior surface and gaspath-facing surface(s) of the platform, the shroud, etc. The overlay coating as defined herein includes, but is not limited to, Cathodic Arc metallic bondcoat, and external duplex electron beam-physical vapor deposition (EB-PVD) ceramic coating.

In one example, the overlay coating includes a duplex Thermal Barrier Coating (TBC) having a first layer of a yttria-stabilzed zirconia (YSZ, e.g., 7 weight percent yttria (7YSZ))) and a second layer of a gadolinia-stabilized zirconia (GSZ, e.g., 59 weight percent gadolinia (59GSZ)). The TBC may be atop a metallic bondcoat such as a MCrAlY bondcoat, namely a NiCoCrAlY that is cathodic arc deposited directly atop the substrate.

The method 300 for applying a metallic coating to a component differs from conventional coatings at least in part as the Chromium slurry is applied in a localized manner in conjunction with the external cathodic arc metallic bondcoat. The Chromium slurry may, if applied in a conventional non-localized manner, otherwise disturb the cathodic arc metallic bondcoat. The method 300 thus provides an economical and efficient application of Cr-rich coatings and a cathodic arc metallic bondcoat.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to normal operational attitude and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed:

1. A method of coating an interior of an internally cooled turbine component for a gas turbine engine, comprising:

flowing a chromium slurry without a filler into an array of internal passageways within an airfoil section of an internally cooled turbine component, the chromium slurry defines a viscosity of about 100-200 cp, wherein the chromium slurry, in terms of weight percentages, comprises 48.5-68% by weight Chromium powder, about 0.9-3.4% by weight Chromium Chloride (CrCl3) particles, and about 30-50% by weight organic binder;

draining the chromium slurry from within the array of internal passageways;

drying the chromium slurry to drive off the organic binder; and heat treating the component.

2. The method as recited in claim 1, wherein the component is a blade.

3. The method as recited in claim 1, wherein the component is a vane.

4. The method as recited in claim 1, wherein the drying comprises drying at about 200F for about 1 hour.

5. The method as recited in claim 1, wherein the heat treating comprises heat treating at about 1925F (1052C) to about 2000F (1093C), for a time of from about 5 to about 6 hours.

6. The method as recited in claim 1, further comprising:

cathodic arc depositing a bondcoat to an external surface of the component.

7. The method as recited in claim 6, further comprising applying a thermal barrier coating atop the bondcoat.

8. A method of coating an interior of an internally cooled turbine component for a gas turbine engine, comprising:

flowing a chromium slurry without a filler that defines a viscosity of about 100-200 cp into an array of internal passageways within an airfoil section of a component, wherein the chromium slurry, in terms of weight percentages, comprises 48.5-68% by weight Chromium powder, about 0.9-3.4% by weight Chromium Chloride (CrCl3) particles, and about 30-50% by weight organic binder;

draining the chromium slurry from within the array of internal passageways within the component;

drying the chromium slurry to drive off the organic binder at about 200F for about 1 hour;

heat treating the component at about 1925F (1052C) to about 2000F (1093C) for about 5 to about 6 hours;

cathodic arc depositing a bondcoat to an external surface of the component; and applying a thermal barrier coating atop the bondcoat.

* * * * *